US005540291A

United States Patent [19]

Coleman

[11] Patent Number: 5,540,291

[45] Date of Patent: Jul. 30, 1996

[54] SWITCH ACTUATOR FOR A PORTABLE POWER TOOL

[75] Inventor: Harold J. Coleman, Phoenix, Ariz.

[73] Assignee: Ryobi Outdoor Products, Chandler, Ariz.

[21] Appl. No.: 264,188

[22] Filed: Jun. 22, 1994

Related U.S. Application Data

[63] Continuation of Ser. No. 96,679, Jul. 23, 1993, abandoned.

[51] Int. Cl.[6] ..... B26B 27/00

[52] U.S. Cl. ..... 173/170; 30/276; 30/296.1

[58] Field of Search ..... 30/276, 296.1; 173/170, 171; 56/12.7, 295

[56] References Cited

U.S. PATENT DOCUMENTS

| | | | |
|---|---|---|---|
| 4,007,526 | 2/1977 | Langenstein . | |
| 4,286,675 | 9/1981 | Tuggle . | |
| 4,360,971 | 11/1982 | Fellmann . | |
| 4,644,654 | 2/1987 | Howe et al. | 30/296.1 |
| 4,696,108 | 9/1987 | Zerrer et al. | 30/276 |
| 4,715,123 | 12/1987 | John et al. . | |
| 4,794,273 | 12/1988 | McCullough et al. | 30/276 X |
| 4,989,323 | 2/1991 | Casper et al. | 30/276 X |
| 5,175,932 | 1/1993 | Lange et al. | 30/276 |
| 5,223,770 | 6/1993 | Schlessmann . | |

*Primary Examiner*—Rinaldi I. Rada
*Attorney, Agent, or Firm*—Brooks & Kushman P.C.

[57] ABSTRACT

A hand held power tool is disclosed comprising an internal combustion engine, a workpiece driven by the engine, a boom extending between the engine and the workpiece, and an actuator for a kill switch of the engine. The actuator includes a collar disposed around the boom, a fingerpiece connected to the collar and movable with the collar between a first position and a second position, and an extension depending from the collar. Preferably, the fingerpiece and the kill switch are disposed on opposite sides a horizontal plane bisecting the boom. The extension engages the kill switch such that when the fingerpiece is moved to the second position, the kill switch interrupts the flow of electricity to the spark plug. Preferably, the collar, fingerpiece and extension being formed as a unitary piece.

8 Claims, 9 Drawing Sheets

SWITCH ACTUATOR FOR A PORTABLE POWER TOOL

This is a continuation of application Ser. No. 08/096,679 filed on Jul. 23, 1993, abandoned.

TECHNICAL FIELD

This invention relates to hand held power tools, and more particularly to an actuator for operating a kill switch of an internal combustion engine of a power tool.

BACKGROUND ART

Hand held power tools such as line trimmers are typically powered by electric motors or small, single cylinder internal combustion engines. In the case of power tools equipped with engines, some means is usually provided for ceasing operation of the engine when the operator no longer desires to work with the unit. One popular method of accomplishing this is through the use of an on/off or kill switch which grounds the supply of electricity to the spark plug. U.S. Pat. No. 4,286,675 to Tuggle, for example, discloses a narrow profile power handle for a line trimmer and the like having an ignition kill switch situated near a hand grip portion of a rear handle. For power tools such as line trimmers in which the engine is normally carried behind the operator, however, an ignition kill switch disposed proximate the engine would require the operator to remove one or both hands from their normal operating positions in order to manipulate the switch.

Another problem frequently associated with hand held power tools is the transmission of engine vibrations to the operator. Although the power tools may be provided with padded handles or other low cost devices to dampen some of the vibrations, an improved system for isolating the entire engine from the operator and the remainder to the power tool would be desirable.

SUMMARY OF THE INVENTION

The present invention is a hand held power tool such as a line trimmer comprising an internal combustion engine, a workpiece driven by the engine, a boom extending between the engine and the workpiece, and an actuator for a kill switch of the engine. The actuator includes a collar disposed around the boom, a fingerpiece connected to the collar and movable with the collar between a first position and a second position, and an extension depending from the collar. Preferably, the fingerpiece and the kill switch are disposed on opposite sides of a horizontal plane bisecting the boom. The extension engages the kill switch such that when the fingerpiece is moved to the second position, the kill switch interrupts the flow of electricity to the spark plug. Preferably, the collar, fingerpiece and extension being formed as a unitary piece.

Accordingly, it is an object of the present invention to provide a power tool of the type described above which does not require the operator to remove one or both hands from their normal operating positions in order to manipulate a kill switch.

Another object of the present invention is to provide a power tool of the type described above in which the actuator is capable of operating a kill switch situated on the opposite side of, and therefore at least partially obstructed by, the boom.

Another object of the present invention is to provide a power tool of the type described above which dampens the transmission of engine vibrations to the operator.

These and other objects, features, and advantages of the present invention are readily apparent from the following detailed description of the best mode for carrying out the invention when taken in conjunction with the accompanying drawings.

BEST MODE FOR CARRYING OUT THE INVENTION

Figure 1:
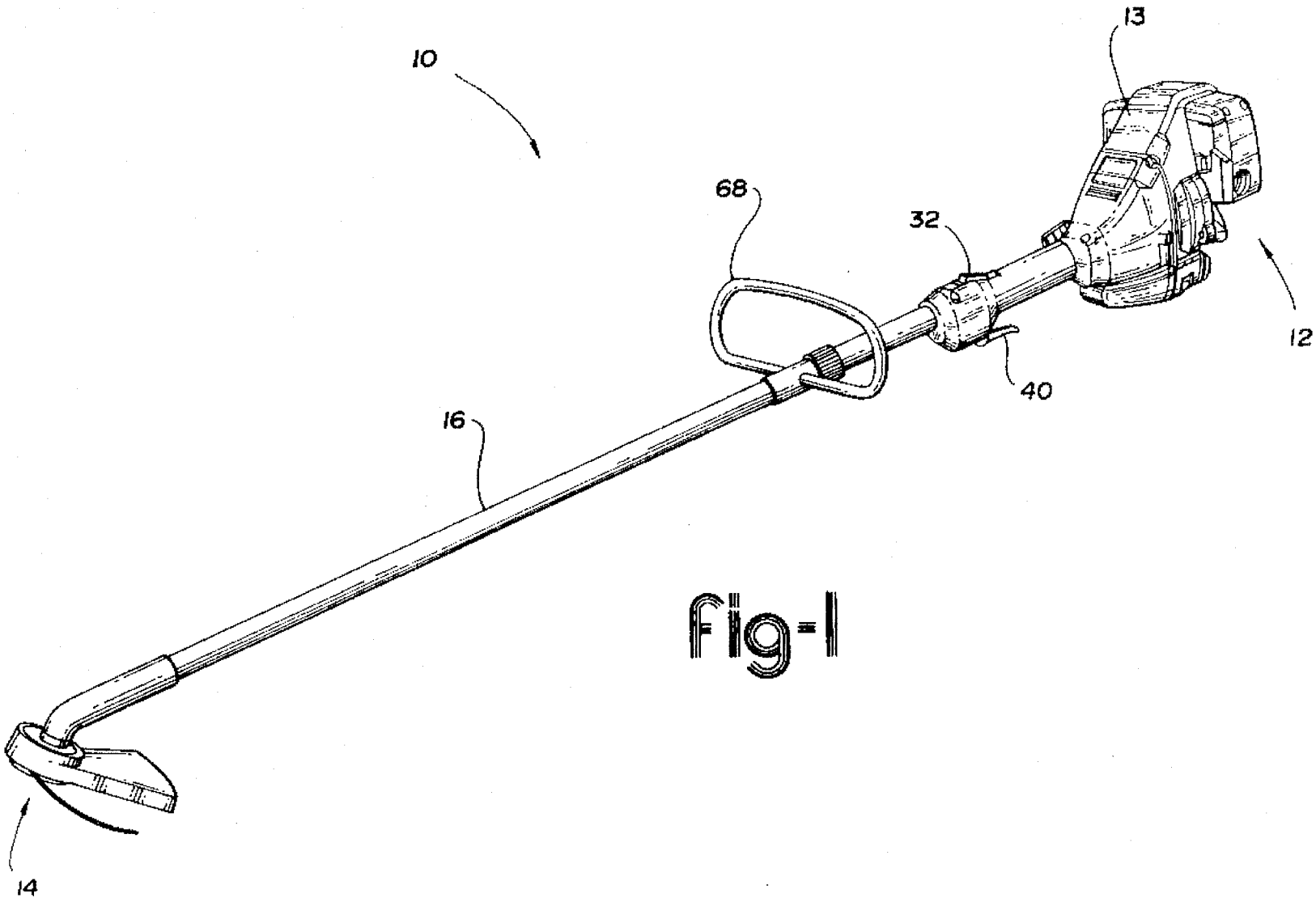
FIG. 1 is a perspective view of a hand held line trimmer according to the present invention.
Figure 2:
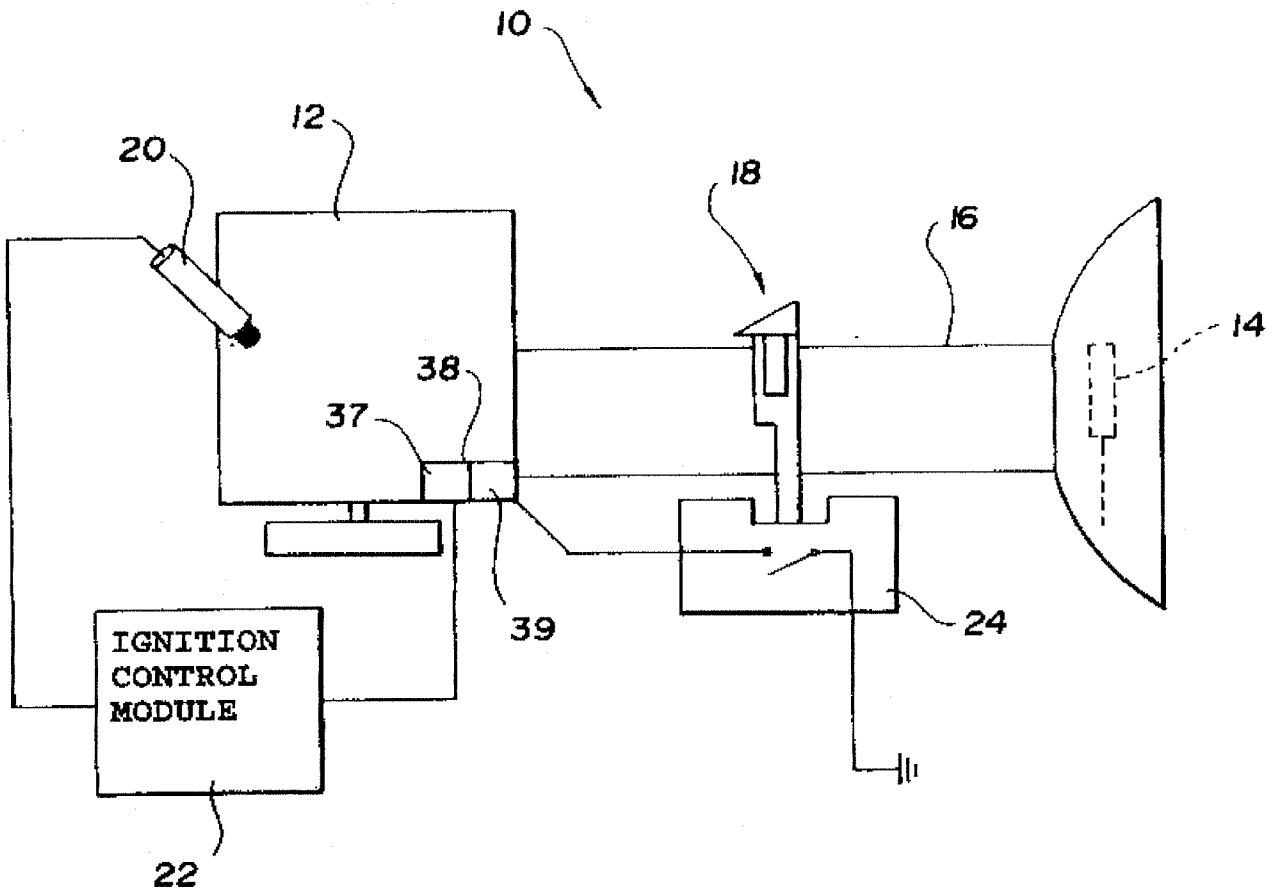
FIG. 2 is a schematic view of the hand held line trimmer.
Figure 3:
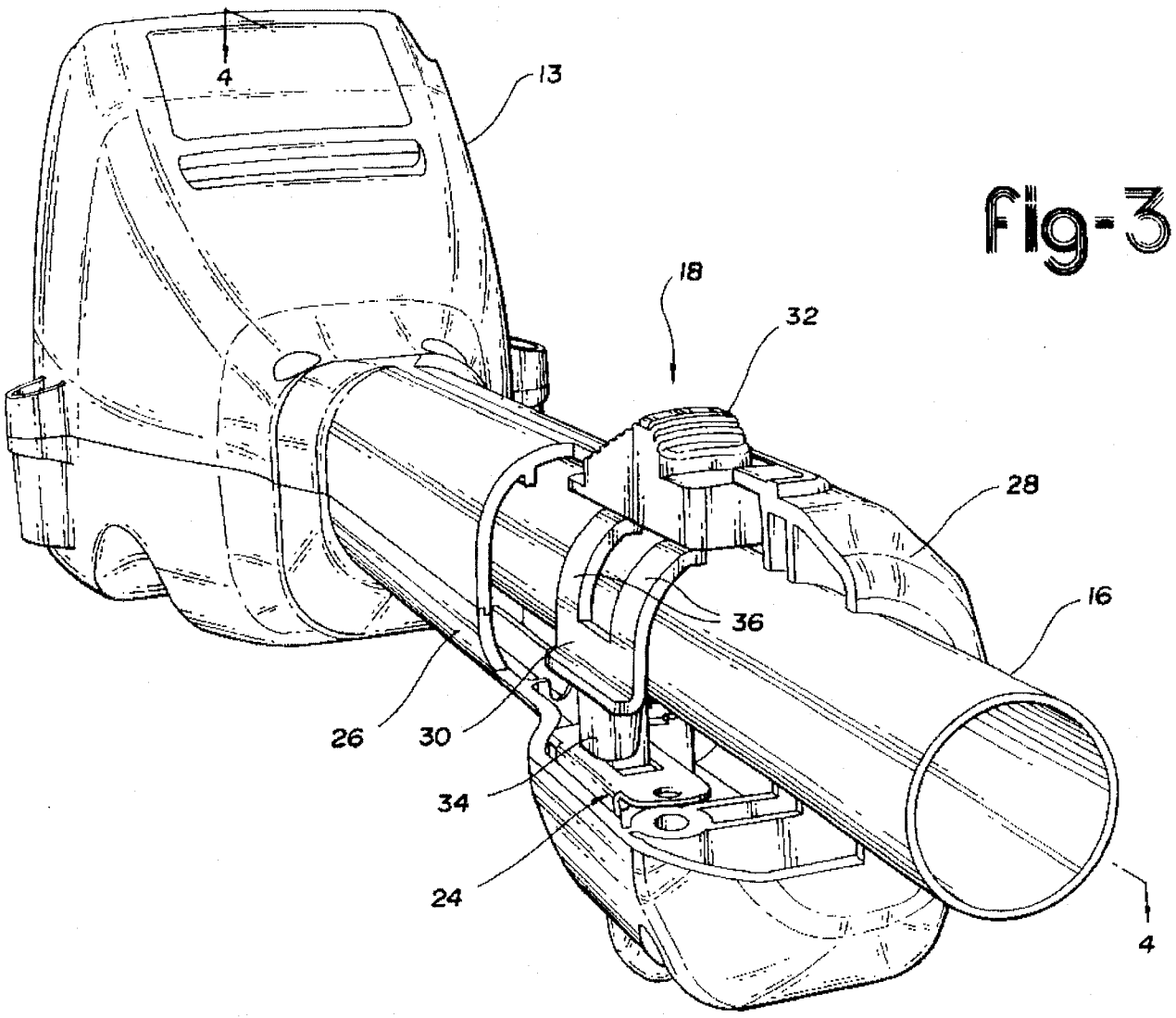
FIG. 3 is a cut away perspective view of a section of the line trimmer including an actuator assembly for an engine kill switch.

With reference to the drawing, the preferred embodiments of the present invention will be described. FIGS. 1 through 7 and 12 show a line trimmer 10 according to the present invention for use in perfoming lawn and garden work. The line trimmer 10 includes a single cylinder two- or preferably four-cycle internal combustion engine 12 housed in a power head assembly 13, a workpiece 14 driven by the engine, an elongated tube or boom 16 extending between the engine and the workpiece, and an actuator 18.

The ignition system for the engine 12 includes a spark plug 20, an electronic ignition control module 22, and an on/off or kill switch 24 wired in an electrical circuit. The spark plug 20 provides a spark to combust a fuel-air mixture in the cylinder of the engine 12, while the electronic ignition control module 22 includes a microprocessor for controlling the timing of the sparks generated by the spark plug 20, as is well known.

The kill switch 24 is positively mounted in the lower of two housing halves 26 and 28 under the boom 16, which is preferably cylindrical and has a uniform thickness, generally circular cross-section throughout its length. With the kill switch mounted in a relatively protected position beneath the boom and inside the housing halves, the actuator 18 enables the operator of the power tool 10 to trip the kill switch 24 and thereby to stop the operation of the engine 12. The actuator 18 comprises a collar 30, a fingerpiece or thumbpiece 32, and an extension 34, all of which are preferably formed as a unitary, injection molded plastic piece. The collar 30 includes opposite depending, relatively flexible legs 36 which slidingly engage the exterior of the boom 16 such that the collar is disposed therearound. The boom 16 serves to smoothly guide and retain the actuator 18 during assembly and operation of the unit.

The fingerpiece 32 is connected to the top of the collar 30 and is movable with the collar between a first or normal operating position and a second position. In the first position with the fingerpiece 32 slid rearwardly toward the engine 12, the electrical circuit is closed between the high voltage side 37 of an ignition coil 38 of the engine and the electronic ignition control module 22 such that electricity can be supplied to the spark plug 20. When the operator wishes to terminate operation of the engine 12, the fingerpiece 32 is simply slid forwardly away from the engine to move the collar 30.

The extension 34 depends from the collar 30 and is adapted to engage the kill switch 24 such that when the fingerpiece 32 is moved to the second position, the kill switch closes an electrical circuit including the low voltage side 39 of the ignition coil 38 and a ground. This grounds the electrical circuit between the spark plug 20 and the electronic ignition control module 22, but it should be understood that any other method of interrupting or breaking the supply of electricity to the spark plug is acceptable. Of course, the actuator and kill switch arrangement is equally applicable to an engine equipped with a conventional magneto to supply electrical current to the spark plug. Because one of the operator's hands normally grips the housing halves 26 and 28 to operate a throttle trigger 40, the fingerpiece 32 is easily accessible and movable in either the forward or rearward directions. Engine operation can thus be terminated without the operator removing his or her hands from their operating positions.

Figure 4:
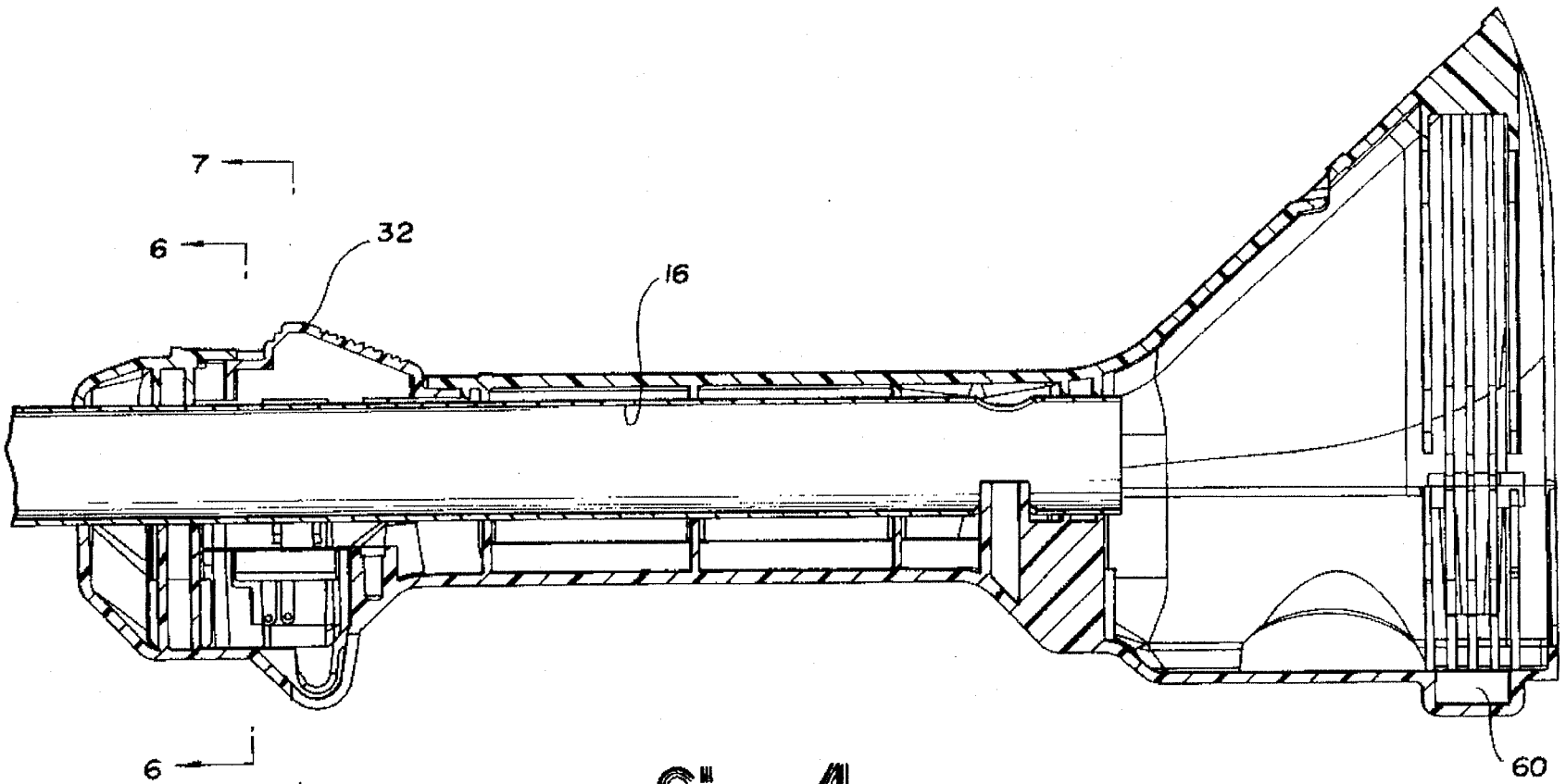
FIG. 4 is a cross-sectional view of the line trimmer taken along line 4—4 in FIG. 3.
Figure 5:
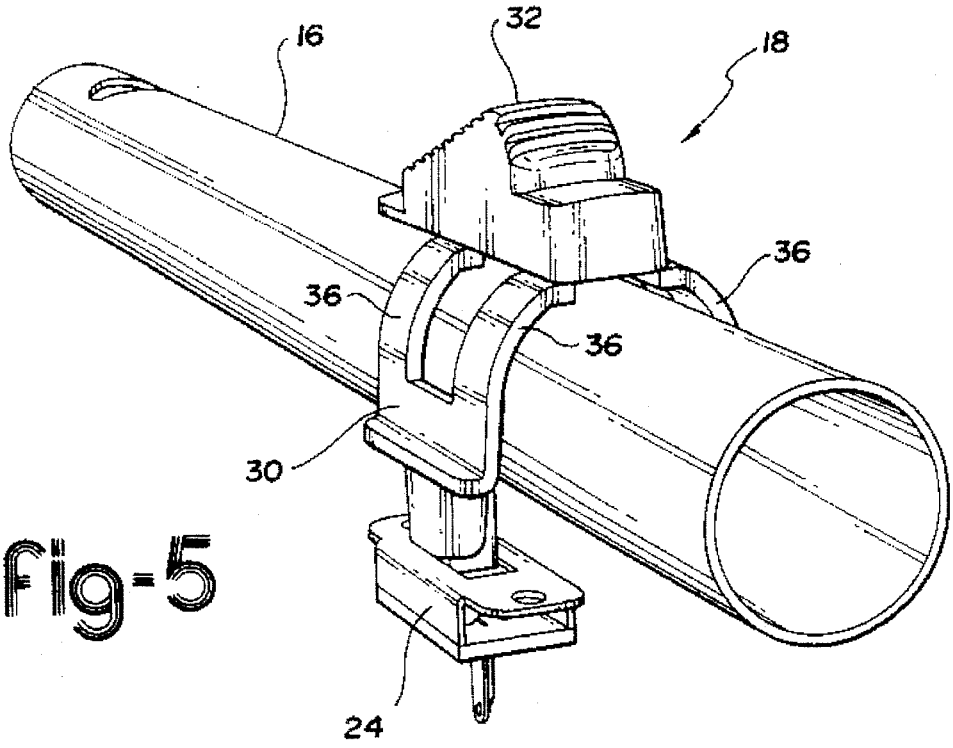
FIG. 5 is a perpective view of the actuator assembly, boom and kill switch shown in FIG. 2.
Figure 6:
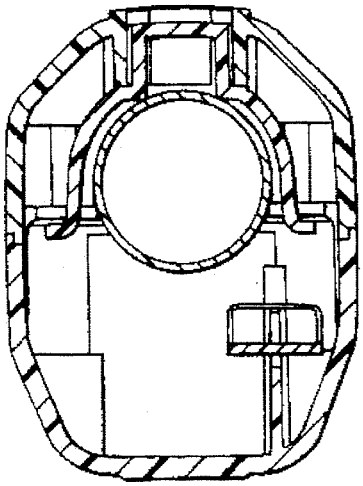
FIG. 6 is a cross-sectional view taken along line 6—6 in FIG. 4.
Figure 7:
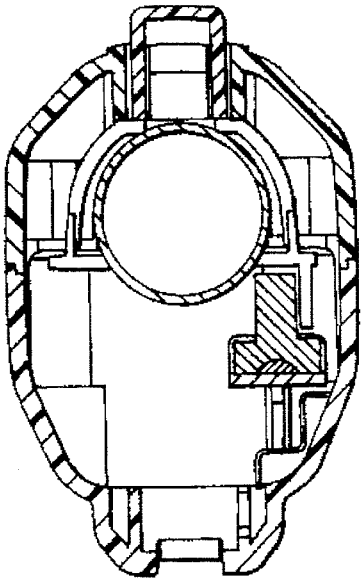
FIG. 7 is a cross-sectional view taken along line 7—7 in FIG. 4.

The power tool 10 has an arbitrary upright orientation in which the fingerpiece 32 points upwardly and the boom 16 lies generally in a horizontal plane as shown in FIG. 4 through the central axis of the boom. The upright orientation should be distinguished from the normal operating position in which the boom 16 is angled downwardly to the ground from near the operator's waist. In the upright orientation, the fingerpiece 32 and the kill switch 24 are disposed on opposite sides of the horizontal plane. Although the boom 16 of the present invention is preferably substantially straight throughout its entire length, the boom can alternately be formed with one or more straight sections joined together at various angles, or can be formed with one or more curved sections.

The actuator of the present invention offers several advantages, including the provision of a high quality feel with a relatively inexpensive switch, and the ability to locate the kill switch and its related wiring in the bottom assembly half of the power tool. The kill switch is thus more accessible for repair or replacement, but does not fall out during more common types of service. Furthermore, the actuator is guided and retained by the boom, and can be formed from a resiliant material which allows the part to be "popped" on and off of boom for easy assembly and disassembly.

Figure 8:
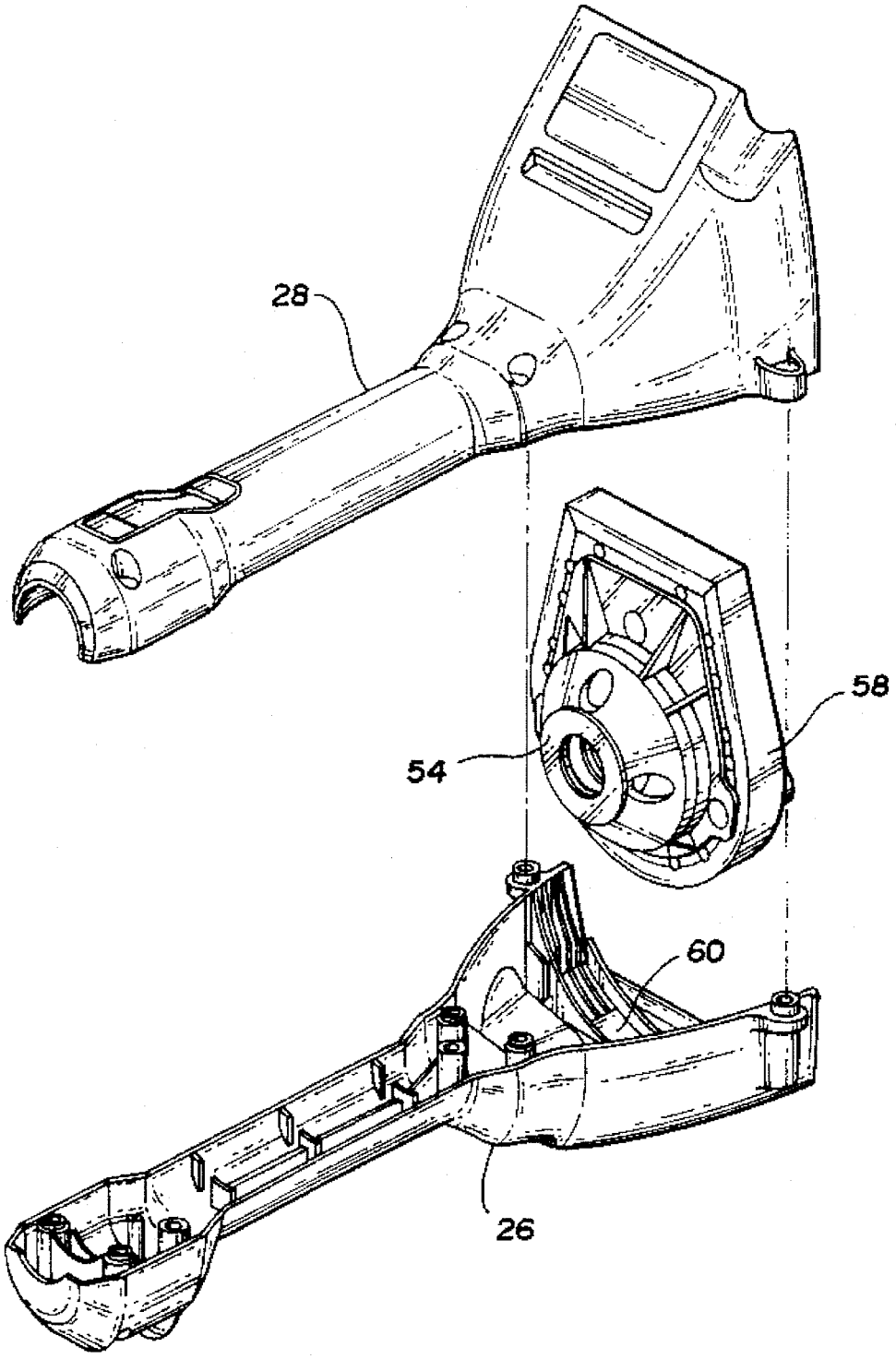
FIG. 8 is an exploded perspective view of a section of the line trimmer including a clutch housing and an isolator.
Figure 9:
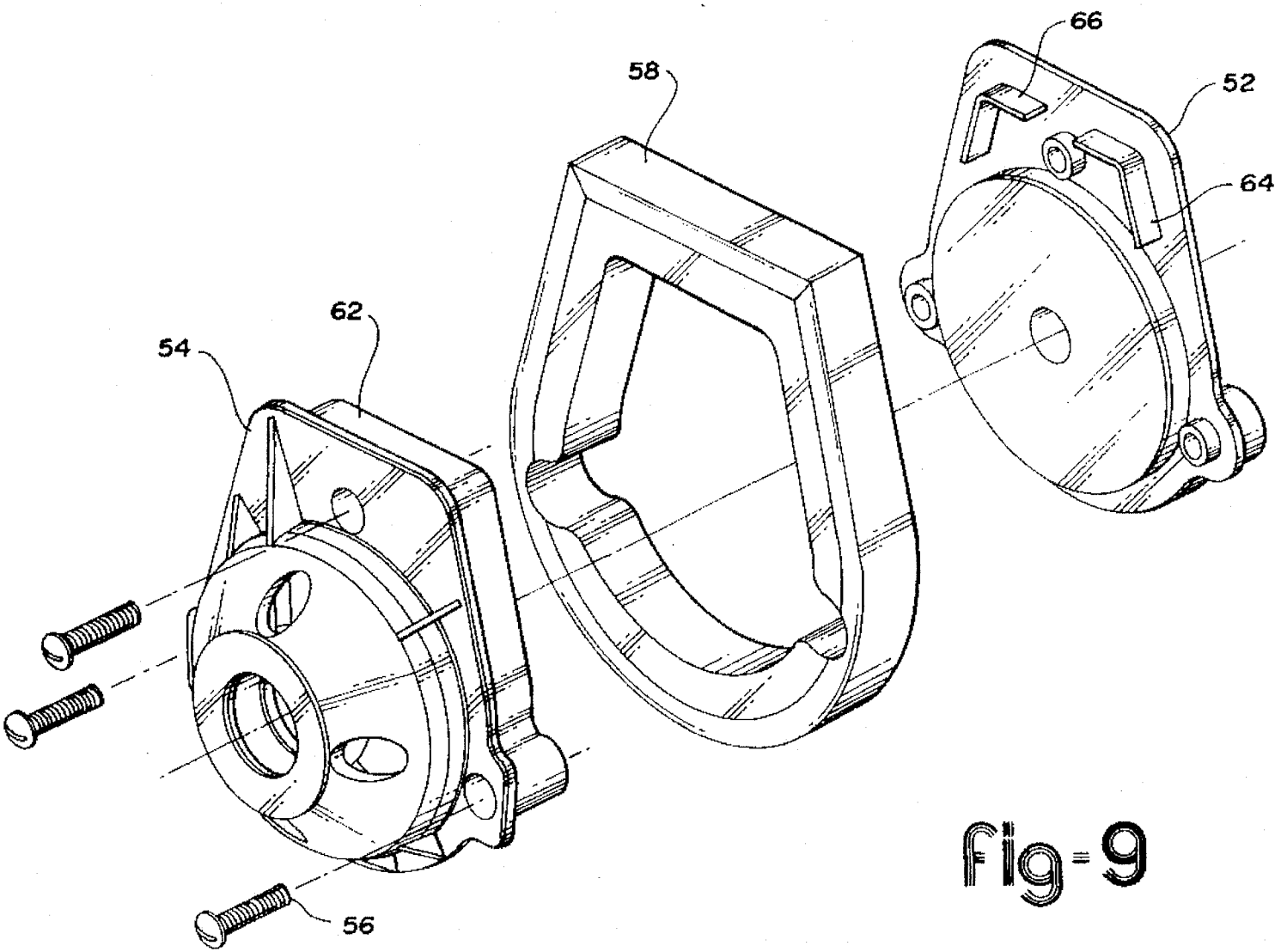
FIG. 9 is an exploded perspective view of the clutch housing, isolator and a starter housing.

FIGS. 8 and 9 show a boom section 50, including the boom 16 and its upper and lower housing halves 26 and 28, extending between the internal combustion engine 12 and the workpiece 14. When assembled, a starter module or housing 52 is connected to the engine 12 and a clutch housing 54, which encloses a clutch drum, is attached to the starter housing by fasteners 56 extending therebetween. A thermoplastic rubber (TPR) isolator 58 is disposed between the clutch housing 54 and the starter module 52, and extends outwardly beyond their perimeters so that the outer periphery of the isolator is retained in a channel 60 formed in the upper and lower housing halves. The inner periphery of the isolator 58 is retained by a flange 62 extending from the clutch housing 54, and near its upper lefthand and righthand corners by flanges 64 and 66 extending from the starter housing 52. The isolator 58 is preferably about one-half to three-quarters of an inch thick, and preferably has a generally uniform thickness throughout its perimeter. The isolator 58 thus separates the handle 68 and the boom from the engine clutch and starter modules.

The isolator 58 functions to dampen the transmission of engine vibration forces to the operator. The fasteners 56 do not penetrate the isolator 58, and thus the isolator is held in place by the frictional forces applied around its perimeter by the clutch housing and the starter housing. Because the isolator 58 is completely soft mounted, i.e. it has no direct feature receiving an increased load due to a mechanical attachment, local stresses are avoided which might lead to a premature failure of the isolator.

The isolator 58 is of a size sufficient to create effective total engine support. This support enables damping of engine vibrations regardless of their direction or moment. For instance, various vibrations produced by the engine may include vibration due to the unbalanced couple of a half crank or cantilevered crankshaft engine, the X-Y forces due to an unbalanced reciprocating mass, and the tangential torque reaction around the z-axis of a two-cycle or four cycle engine.

Figure 10:
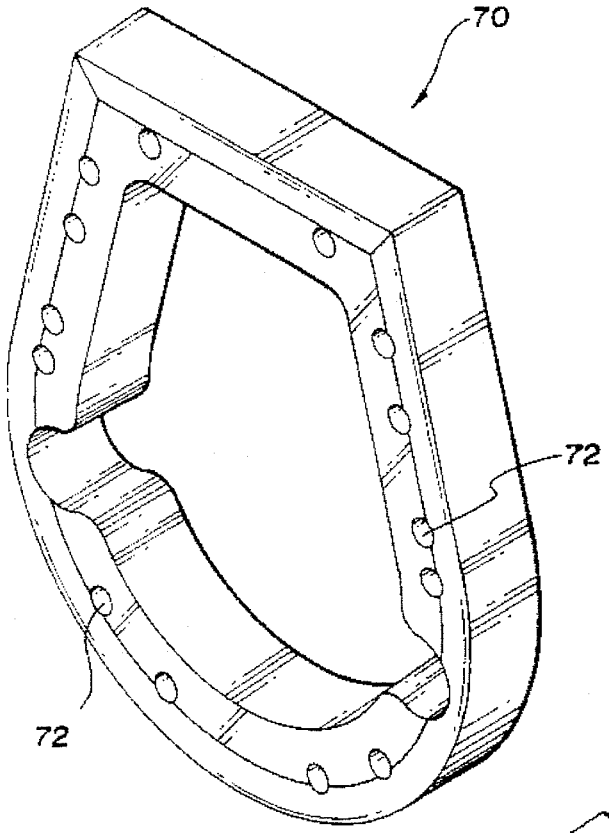
FIG. 10 is a perspective view of an alternative embodiment of the isolator.
Figure 11:
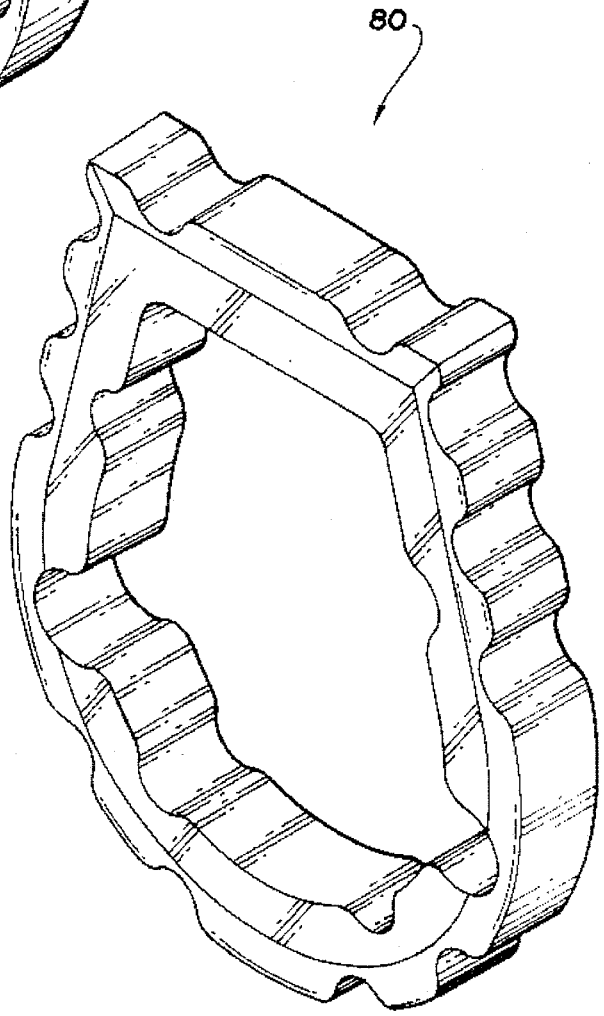
FIG. 11 is a perspective view of another alternative embodiment of the isolator.
Figure 12:
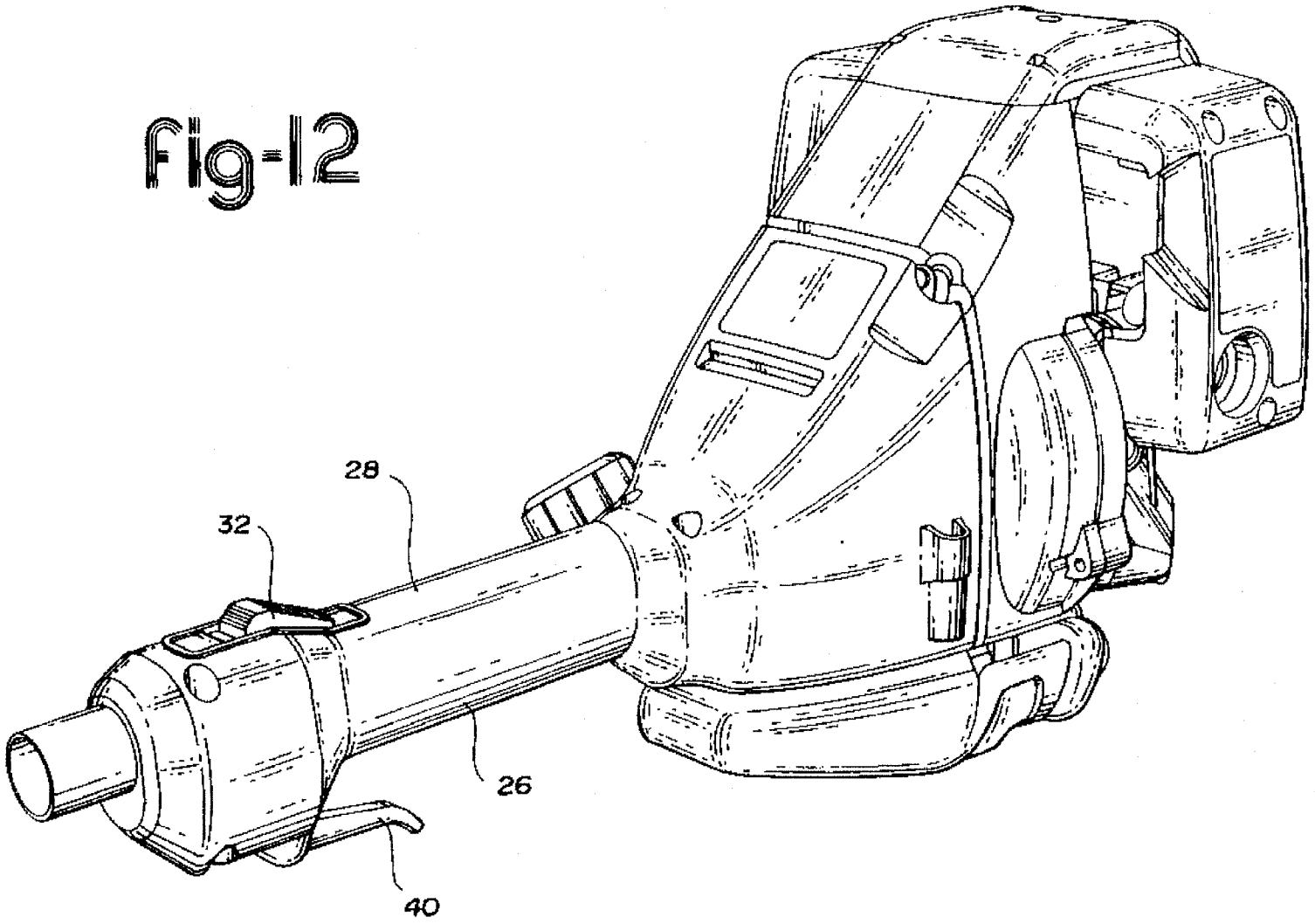
FIG. 12 is a perspective view of the head assembly of the line trimmer.

FIG. 10 shows an alternative embodiment 70 of the isolator having a plurality of holes 72 distributed around the perimeter. The holes 72 create a higher shear component to enable proper resonance and decrease transmissibility. FIG. 11 shows another alternative embodiment 80 of the isolator which accomplishes the same objective.

Although the present invention has been described in connection with a hand held line trimmer, it should be appreciated that the present invention is equally applicable to other hand held power tools such as chain saws, etc. It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

I claim:

1. A hand held power tool comprising:

an internal combustion engine having a spark plug, a kill switch, a workpiece driven by the engine, an elongated boom extending between the engine and the workpiece, an actuator including:

a collar shiftably cooperting with the boom for movement along an axis of the boom, a fingerpiece connected to the collar and movable with the collar relative to the boom between a first position and a second position, and an extension depending from the collar engaging the kill switch such that when the fingerpiece is moved to the second position, the kill switch interrupts the flow of electricity to the sparkplug.

2. An actuator for a kill switch of a hand held power tool including an internal combustion engine, a spark plug, a workpiece driven by the engine, and an elongated boom extending between the engine and the workpiece, the actuator comprising:

a collar slidably mounted to the boom for movement relative thereto along an axis of the boom;

a fingerpiece connected to the collar and axially movable with the collar relative to the boom between a first position and a second position; and an extension depending from the collar and engaging the kill switch such that when the fingerpiece is moved to the second position, the kill switch interrupts the flow of electricity to the sparkplug.

3. The actuator of claim 1 wherein the power tool has an upright orientation with the boom lying generally in a horizontal plane, the fingerpiece and the kill switch being disposed on opposite sides of the plane.

4. The actuator of claim 1 wherein the collar, fingerpiece and extension are formed as a unitary piece.

5. The actuator of claim 1 wherein the kill switch grounds an electrical circuit between the sparkplug and an ignition coil when the fingerpiece is moved to the second position.

6. The actuator of claim 1 wherein the boom has a generally circular cross-section.

7. The actuator of claim 1 wherein the power tool comprises a line trimmer.

8. An actuator for a kill switch of a hand held line trimmer including an internal combustion engine, a spark plug, a workpiece driven by the engine, and an elongated tubular boom extending between the engine and the workpiece, the power tool having an upright orientation with the boom lying generally in a horizontal plane, the actuator comprising:

a collar disposed around the boom;

a fingerpiece connected to the collar and slideably movable with the collar relative to the boom between a first position and a second position, the fingerpiece and the kill switch being disposed on opposite sides of the horizontal plane; and an extension depending from the collar; the collar, fingerpiece and extension being formed as a unitary piece.

* * * * *